US005507678A

United States Patent [19]

Chiang

[11] Patent Number: 5,507,678

[45] Date of Patent: Apr. 16, 1996

[54] DOLL WITH EXTENDABLE LIMBS

[76] Inventor: John Chiang, 25 Oak Ridge Dr., Voorhees, N.J. 08043

[21] Appl. No.: 328,202

[22] Filed: Oct. 25, 1994

[51] Int. Cl.[6] ..... A63H 3/02

[52] U.S. Cl. ..... 446/369; 446/390

[58] Field of Search ..... 446/320, 321, 446/489, 330, 333, 334, 336, 368, 369, 370, 376, 390, 221, 226

[56] References Cited

U.S. PATENT DOCUMENTS

| | | | |
|---|---|---|---|
| 1,310,205 | 7/1919 | Morgenstern | 446/369 |
| 1,606,070 | 11/1926 | Gibson | 446/330 |
| 2,020,079 | 11/1935 | Rabel | 446/390 |
| 2,448,088 | 8/1948 | Duggs | 446/320 |
| 2,708,809 | 5/1955 | Peterson . | |
| 3,930,331 | 1/1976 | Simeone | 446/369 |
| 4,895,546 | 1/1990 | Rakonjac | 446/221 |
| 5,149,288 | 9/1992 | Kelley | 446/320 |
| 5,310,380 | 5/1994 | Levy et al. | 446/320 |

FOREIGN PATENT DOCUMENTS

| | | | |
|---|---|---|---|
| 265062 | 2/1927 | United Kingdom | 446/369 |

*Primary Examiner*—Jessica J. Harrison
*Assistant Examiner*—Michael O'Neill
*Attorney, Agent, or Firm*—Caesar, Rivise, Bernstein, Cohen & Pokotilow, Ltd.

[57] ABSTRACT

A doll having a head, torso and limbs e.g., a pair of arms and a pair of legs. Each pair of limbs is in the form of a unitary elongated member of a fixed length which are movably, e.g., slidably, mounted with respect to the torso so that each of the limbs extend out of the torso. The length that each limb extends out of the torso is adjustable so that an increase in the distance that one limb extends out of the torso correspondingly decreases the length that the other limb extends out of the torso and vice-versa.

4 Claims, 4 Drawing Sheets

FIG. 5
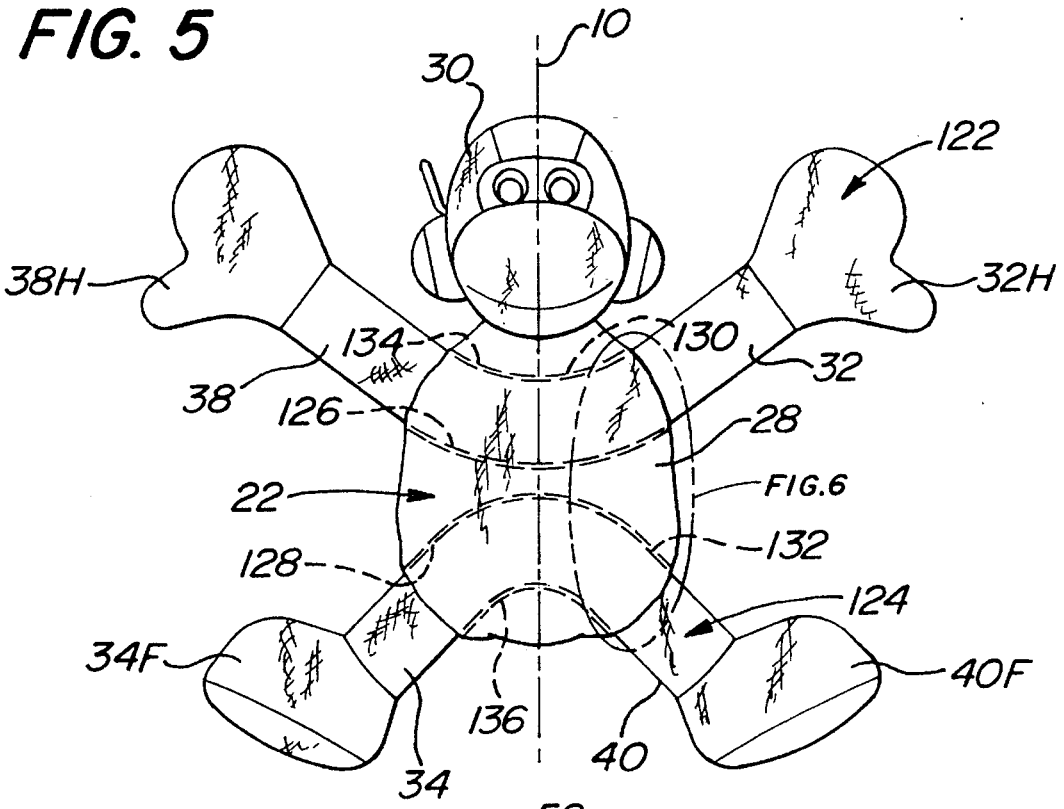
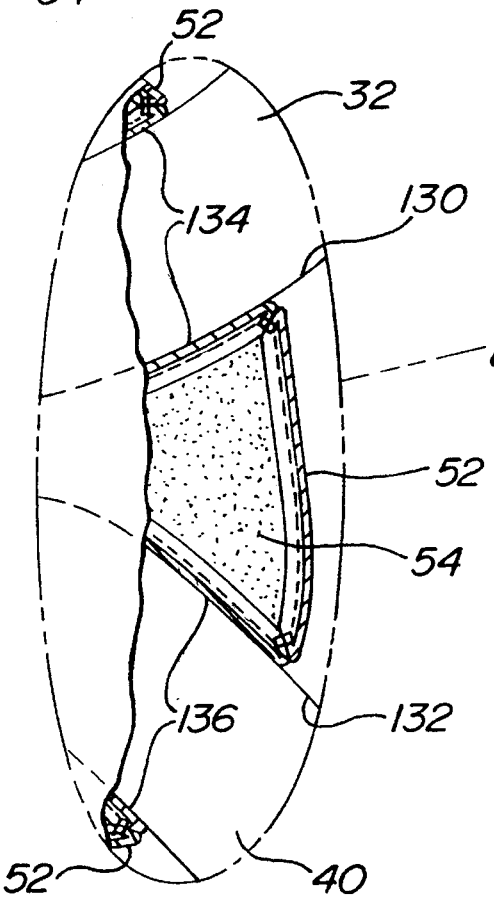
FIG. 6

DOLL WITH EXTENDABLE LIMBS

BACKGROUND OF THE INVENTION

This invention relates generally to dolls, and more particularly to dolls having extendable limbs that can be moved to various positions.

Various types of dolls having moveable limbs are available commercially and the patent literature includes various disclosures of such dolls. For example U.S. Pat. No. 2,669,063 (Lang) discloses a "growing doll" where the doll's internal structure employs coil springs which expand and contract to simulate growth.

U.S. Pat. No. 3,828,467 (Kaelin) also discloses a "growing doll" where the overall height of the doll is selectively adjusted to simulate growth. The doll's legs are attached to a flexible strap which may be grasped and pulled to simultaneously draw the arms and legs into the body of the doll, thereby shortening the overall height of the doll. Thereafter, the legs may be grasped and pulled to simultaneously withdraw the arms and legs away from the body of the doll, thereby increasing the overall height of the doll.

U.S. Pat. No. 4,246,722 (Sapkus) discloses another "growing doll" having an extendable neck and torso and moveable legs. The doll employs a mechanical means to extend the neck and torso and straighten the legs so that the doll appears to grow.

U.S. Pat. No. 4,526,552 (Rhodes) discloses an animated figure toy having a telescoping neck-and-head assembly. The figure toy has an upper torso rotatably connected to a lower torso and the elongated neck-and-head assembly is movably mounted to one of the torsos. When the upper and lower torsos are rotated with respect to each other the elongated head-and-neck assembly moves upwardly away from the torsos.

U.S. Pat. No. 4,608,026 (Newton) discloses a toy action figure having a leg which rocks in one direction to bring about a swinging action in one of the arms. The figure contains a motion converting mechanism for converting the rocking leg movement to the swinging arm movement.

U.S. Pat. No. 5,087,219 (Price) discloses an action character figure which may be adapted to perform a predetermined wrestling maneuver. The action character figure has an arm connected to the leg portion in the interior of the torso such that the rotation of the arms causes the leg portion to be retracted into the torso against the force of an internal biasing means. Thereafter, the arm is released causing the leg portion to be returned to a normal position.

Many such dolls have not met with a great deal of success, particularly because such dolls have been relatively complex and expensive to manufacture and such dolls have been sensitive to handling and easily broken. Also such dolls have usually been constructed of a hard material which could easily injure preschool children.

Although some dolls are constructed of a soft material, such dolls usually have stationary arms and legs which makes the doll less entertaining to preschool children. As a result there is a real need for an inexpensive, uncomplicated, sturdy and entertaining soft plush doll having movable arms and legs.

OBJECTS OF THE INVENTION

Accordingly, it is the general object of this invention to provide a doll which meets the above mentioned need.

It is a further object of this invention to provide a doll having extendable limbs, to enable one to change the shape and appearance of the doll, thereby enhancing the entertainment value of the doll.

It is yet a further object of this invention to provide a doll having a pair of movable members each defining a pair of limbs.

It is another object of this invention to provide a doll having interrelated limbs so that moving one limb simultaneously moves another limb, thereby increasing the entertainment value of the doll.

It is still another object of this invention to provide a doll with moveable limbs which is simple in construction and inexpensive to manufacture.

SUMMARY OF THE INVENTION

These and other objects of this invention are achieved by providing a doll having a head, a torso and a plurality of limbs e.g., a pair of arms and a pair of legs. One pair of limbs forms one unitary elongated member of a fixed length and another pair of limbs forms another unitary elongated member of a fixed length. Each unitary elongated member has two ends and a central portion, with each end forming a respective limb, and with the central portion connecting the two limbs.

The unitary elongated member is movably, e.g., slidably, mounted with respect to the torso so that each of the limbs thereof extends out of the torso. The distance that each limb extends out of the torso is adjustable, so that an increase in the distance that one limb extends out of the torso correspondingly decreases the length that the other limb extends out of the torso, and vice-versa.

In accordance with one aspect of the invention at least one of the unitary elongated members comprises one leg and one arm. In accordance with another aspect of the invention at least one of the unitary elongated members comprises a pair of arms or a pair of legs.

DESCRIPTION OF THE DRAWINGS

Other objects and many of the attendant advantages of this invention will be readily appreciated when the same becomes better understood by reference to the following detailed description, when considered in connection with the accompanying drawings wherein:

FIG. 5 is a front elevational view of a doll, with portions shown in phantom, constructed in accordance with a second embodiment of this invention;

FIG. 6 is an enlarged view partially in section, of a portion of the doll of FIG. 5 within the oval area bounded by the phantom lines showing the internal construction of the torso;

DETAILED DESCRIPTION OF THE PREFERRED EMBODIMENTS

Figure 7:
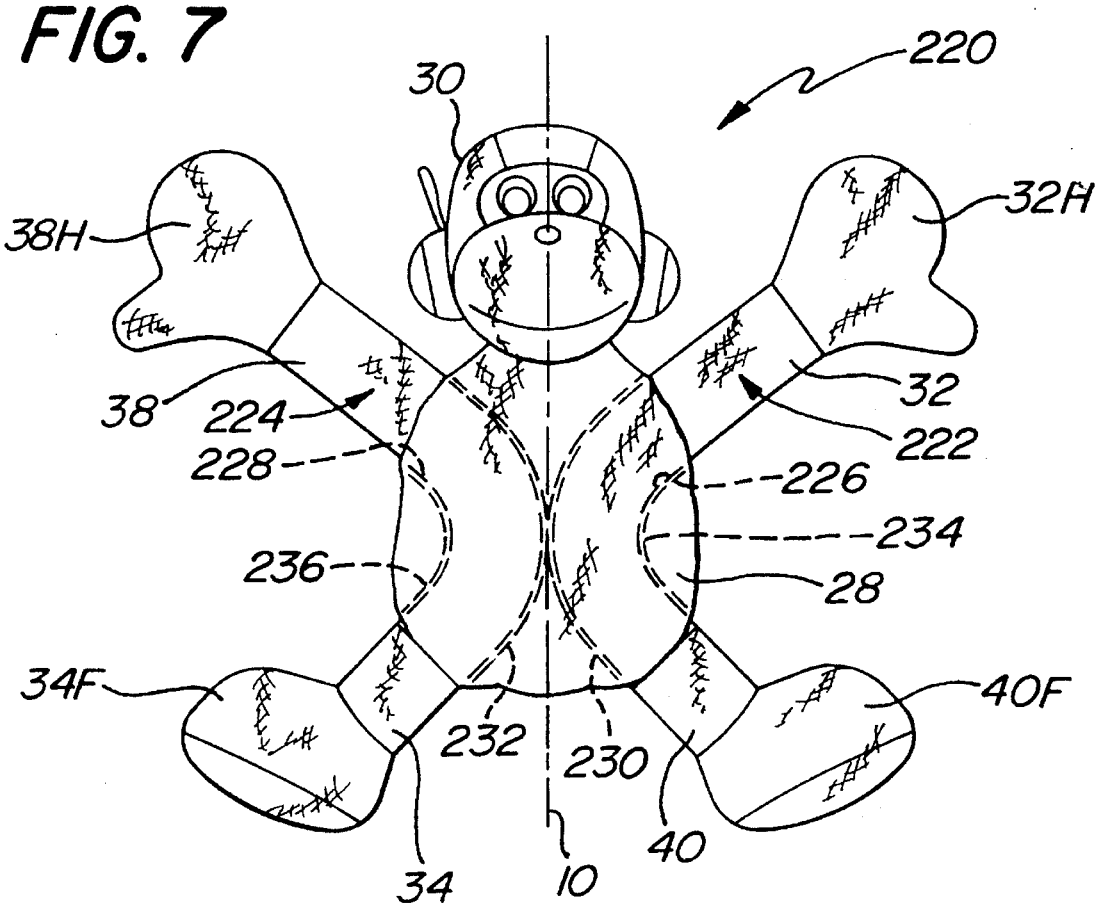
FIG. 7 is a front elevational view of a doll with portions shown in phantom, constructed in accordance with a third embodiment of this invention.

Referring now in greater detail to the various figures of the drawing wherein like reference characters refer to like parts there is illustrated in FIGS. 1–4 a first embodiment 20 of a doll constructed in accordance with this invention. A second embodiment 120 of a doll constructed in accordance with this invention is illustrated in FIGS. 5–6 and will be describe later. A third embodiment 220 of this invention is illustrated in FIG. 7 and will also be describe later.

The doll 20 comprises a head-torso assembly 22, a first limb unit 24 and a second limb unit 26. The doll 20 has a longitudinal axis 10 extending through the head-torso assembly 22. The head-torso assembly 22 basically comprises a torso 28 having passageways for receipt of limb units (as will be described later) and a head 30 secured to the torso 28. The first movable limb unit 24 basically comprises a first unitary elongated member having one end in the form of an arm 32, a second end in the form of a leg 34 and an intermediate or central cylindrical portion 36. In a similar manner the second movable limb unit 26 basically comprises a second unitary elongated member having one end in the form of an arm 38, a second end in the form of a leg 40, and an intermediate or central cylindrical portion 42. As can be seen the arm 32 of the limb unit 24 represents the left arm of the doll 20 while the leg 34 represents the right leg of the doll 20. In a similar manner the arm 38 of the limb unit 26 represents the right arm of the doll 20 while the leg 40 represents the left leg of the doll 20. Each of the movable limb units 24 and 26 comprises an elongated unitary member having a longitudinal axis. In this regard limb unit 24 includes a longitudinal axis 12 and limb unit 26 includes a longitudinal axis 14.

It should be pointed out that this assignment is merely one of various arrangements of the limb units of the subject invention. Thus, for example the movable limb unit 24 may be constructed so that its two ends are in the form of a pair of arms rather than one arm and one leg from opposite sides of the doll's body. Similarly the movable limb unit 26 may be constructed so that its two ends are in the form of a pair of legs rather than one arm and one leg from opposite sides of the doll's body. This second embodiment is illustrated in FIG. 5 and will be discussed later. In addition, the movable limb unit 24 may be constructed so that its ends form one arm and one leg on one side of the doll's body, while the movable limb unit 26 may be constructed so that its ends form the other arm and the other leg on the other side of the doll's body. This third embodiment is illustrated in FIG. 7 and will also be discussed later.

As mentioned previously the torso 28 includes passageways for receiving the intermediate or central cylindrical portions of the limb units therein. Those passageways are designated by the reference numbers 44 and 46 and enable limb units 24 and 26, respectively, to be slid therethrough to adjust the length that the limbs extend outward from the torso 28.

Figure 2:
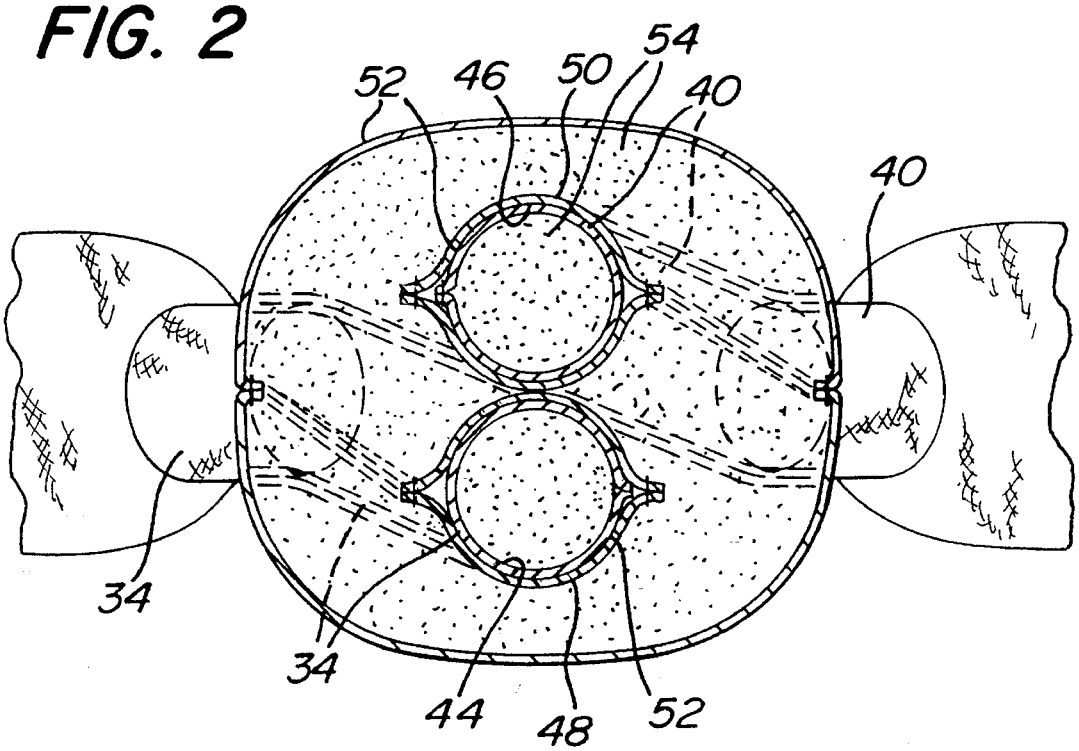
FIG. 2 is an enlarged sectional view taken along the line 2—2 of FIG. 1 showing the internal construction of the torso.

As shown clearly in FIG. 2 the passageway 44 is in the form of a sleeve 48 constructed from a slippery material, e.g. nylon, and the passageway 46 is also in the form of a sleeve 50 constructed from the same material. The head-torso assembly 22 is constructed from an outer fabric 52 of any suitable material and shaped to represent the torso 28 and head 30 of the figure to be represented by the doll, e.g., a monkey as shown in the preferred embodiment herein. The sleeves 48 and 50 extend through the interior of the fabric 52 and their respective ends are sewn to the fabric 52 at the outer surface thereof to form openings at each end of the passageways 44 and 46, respectively. A conventional stuffing material 54 is provided in the space between the inner surface of the fabric 52 and the outer surface of the sleeves 48 and 50 to give shape to the torso 28 and the head 30 of the doll 20. Similarly, each of the limb units 24 and 26 is constructed from an outer fabric 52, like that of the head-torso assembly 22, with stuffing material 54 therein to provide sufficient rigidity.

Figure 1:
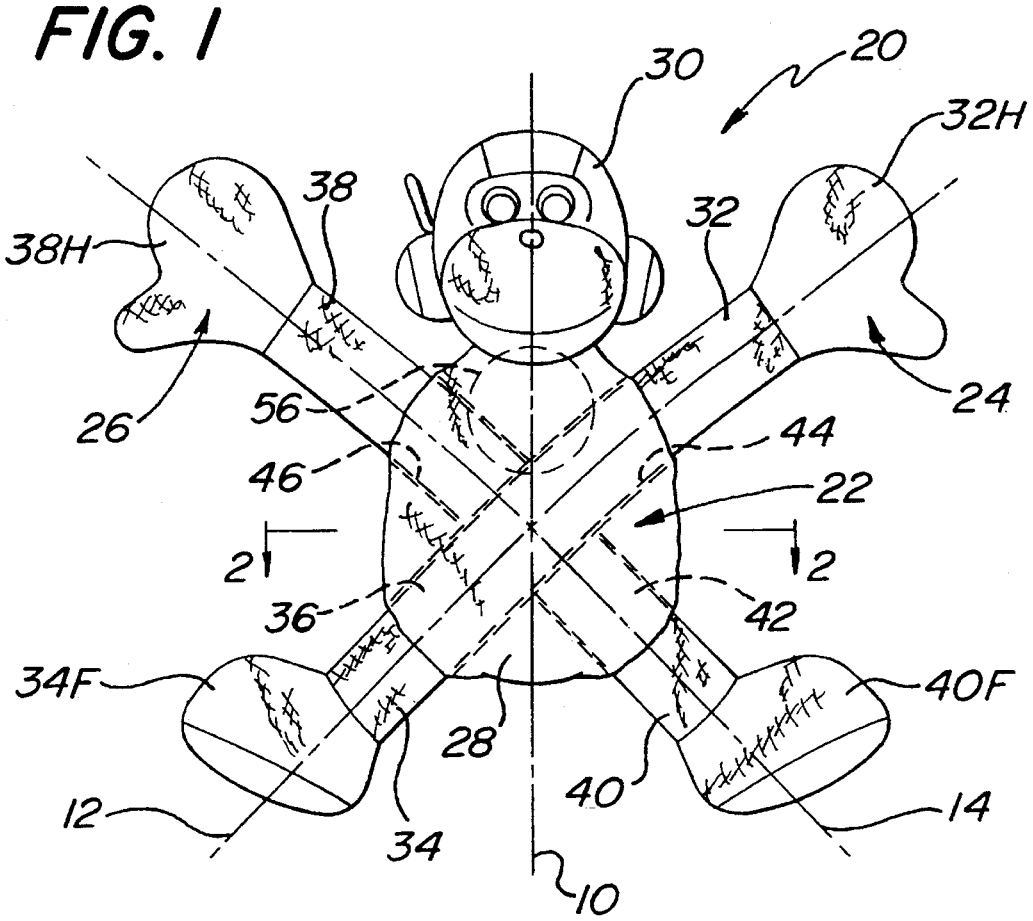
FIG. 1 is a front elevational view of a doll, with portions shown in phantom, constructed in accordance with a first embodiment of this invention.

Each of the limb units 24 and 26 is arranged to freely slide within its respective passageway so that the distance that either end of the limb units 24 and 26 extends out of the torso 28 is adjustable. For example as shown in FIG. 1 the limb units 24 and 26 are slidably secured within the passageways 44 and 46, respectively, so that the portions of those limb units representing the arms 32 and 38 and the legs 34 and 40 extend outward at approximately equal distances from the torso 28.

Figure 3:
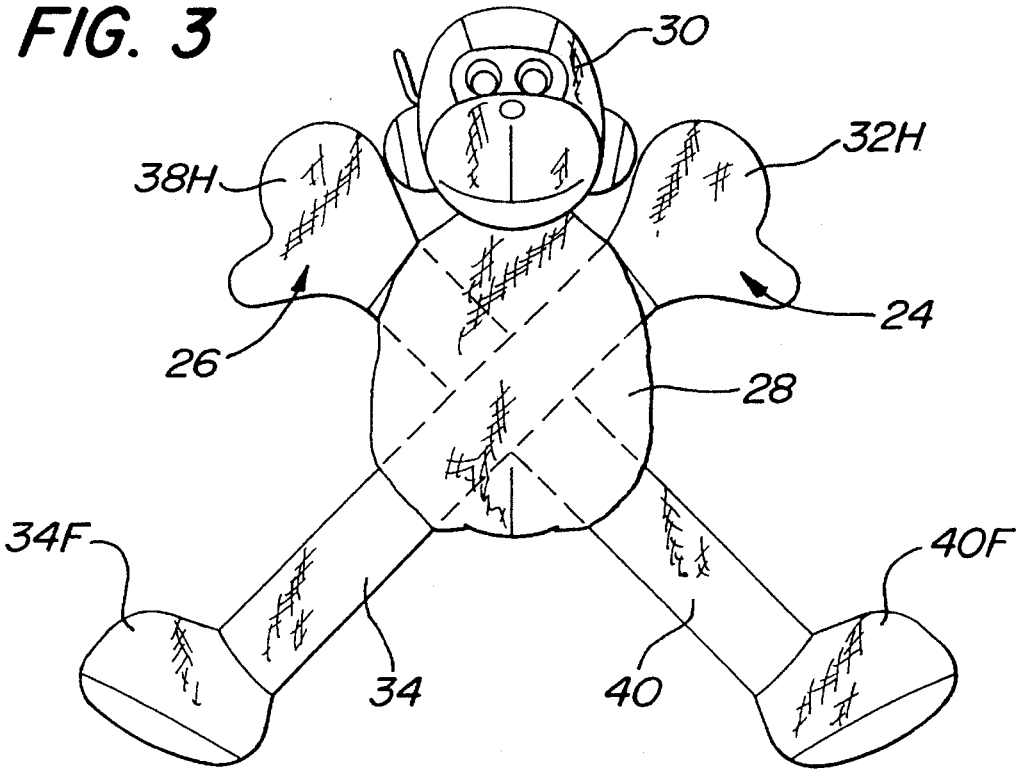
FIG. 3 is a view similar to FIG. 1, but with the legs extended to a maximum distance from the torso.
Figure 4:
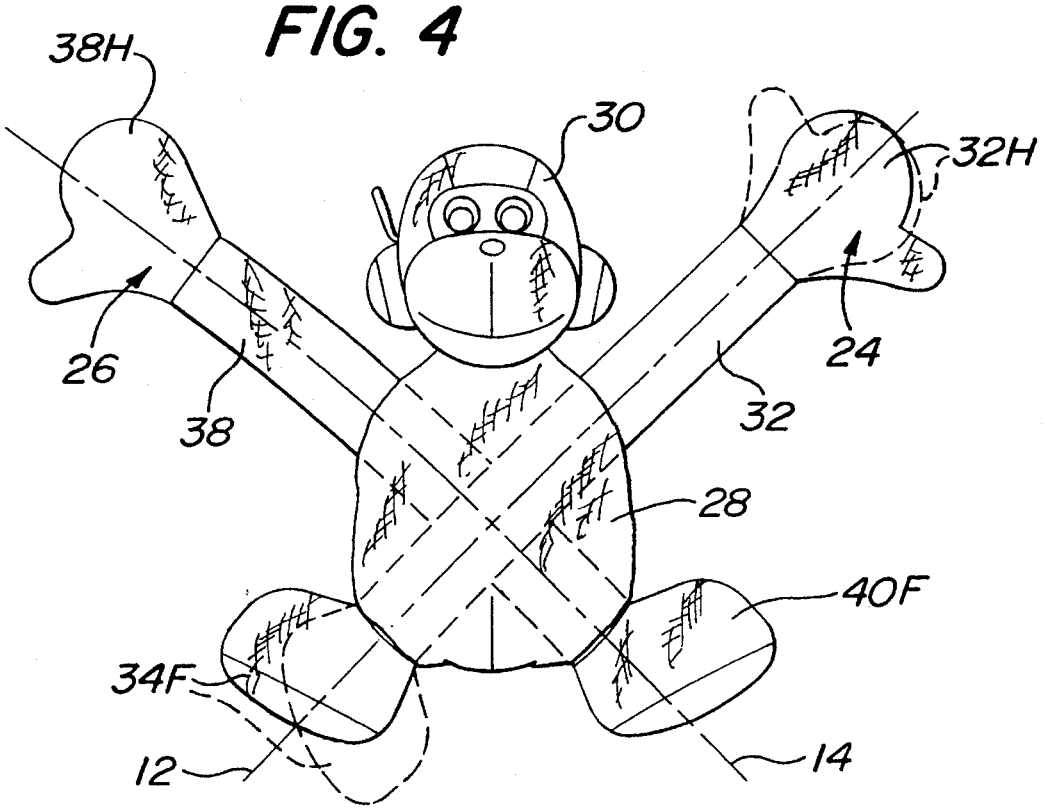
FIG. 4 is a view similar to FIG. 1, but with the arms extended to a maximum distance from the torso.

If it is deemed to have the arms appear shorter all that is required is to slide the two limb units 24 and 26 so that the hand portions 32H and 38H are immediately adjacent or contiguous with the torso 28, thereby extending the feet portions 34F and 40F from the torso 28. As shown in FIG. 3 the feet 34F and 40F are at the maximum distance from the torso 28, thereby giving the doll 20 an appearance of a long legged, short armed monkey. Similarly, if it is deemed to have the legs appear shorter all that is required is to slide the two limb units 24 and 26 so that the feet portions 34F and 40F are immediately adjacent or contiguous with the torso 28, thereby extending the hand portions 32H and 38H from the torso 28. As shown in FIG. 4 the hands 32H and 38H are at the maximum distance from the torso, thereby giving the doll 20 an appearance of a long armed, short legged monkey. Either or both of the limb units 24 and 26 can be slid to any intermediate position, in addition to the positions shown in FIGS. 3 and 4, to provide various appearances of the doll 20.

Moreover, either or both of the limb units 24 and 26 can be rotated, clockwise or counter clockwise, about its longitudinal axis 12 and 14 respectively, so that the hands 32H and 38H and feet 34F and 40F can point in any direction. For example, as shown by the phantom lines in FIG. 4 the limb unit 24 can be rotated 180 degrees about its axis 12 so that the hand 32H and the foot 34F, shown in phantom lines, point in the opposite direction than the hand 32H and the foot 34F shown in full lines. As will be appreciated by those skilled in the art the ability to rotate each of the limb units 24 and 26 about its respective longitudinal axis, while also being able to slide the limb units 24 and 26 with respect to the torso 28 at any position enables the limb units 24 and 26 to be put in a vast multitude of positions, thereby enhancing the entertainment value of the doll 20.

The central portion 36 of the limb unit 24 is more narrow than both the arm 32 and the leg 34 of the limb unit 24. Similarly the central portion 42 of the limb unit 26 is more narrow than both the arm 38 and the leg 40 of the limb unit 26. This prevents the dislodgment of the limb units 24 and 26 from the doll 20. To increase the cross-sectional area at the ends of the limb unit 24 there is included an outwardly extending hand 32H and foot 34F at each end of the limb unit 24, respectively. Similarly to increase the cross-sectional area at the ends of the limb unit 26 there is included an outwardly extending hand 38H and foot 40F at each end of the limb unit 26, respectively.

As shown in FIG. 1 the doll 20 includes a sounding device 56 located within the torso 28 and operative when squeezed to generate a desired sound.

In FIG. 5 there is shown a second embodiment 120 of a doll of this invention. The doll 120 is identical in all respects to the doll 20 except for the construction of its movable limb units and the passageways extending through the torso 28 to receive those limb units. Thus, in the interest of brevity the common features of dolls 20 and 120 will be given the same reference numerals and the details of their construction will not be reiterated. To that end, the doll 120 includes a first movable limb unit 122 and a second movable limb unit 124. The first movable limb unit 122 basically comprises a first unitary elongated member having one end in the form of an arm 32, a second end in the form of another arm 38 and an intermediate or central cylindrical portion 126. In a similar manner the second movable limb unit 124 basically comprises a second unitary elongated member having one end in the form of a leg 34, a second end in the form of another leg 40 and an intermediate or central cylindrical portion 128.

The torso 28 of the doll 120 includes an upper passageway 130 and a lower passageway 132 for slidably receiving the limb units 122 and 124, respectively. The passageways 130 and 132 are formed the by the sleeves 134 and 136, respectively, constructed similarly to the sleeves 48 and 50 of the doll 20 but oriented so that each of the passageways 130 and 132 extends generally transversely to the longitudinal axis 10. In particular the upper sleeve 134 is curved slightly upward, with its central portion 126 extending generally perpendicular to the longitudinal axis 10. The curvature is provided so that when the limb unit 122 is located therein the arms 32 and 38 are directed slightly upward. In a similar manner the lower sleeve 136 extends generally transversely to the longitudinal axis 10 and it is curved slightly downward, with its central portion 128 extending generally perpendicular to the longitudinal axis 10. The curvature is provided so that when the limb unit 124 is located therein the legs 34 and 40 are directed slightly downward.

As can be seen in FIG. 6 the upper and lower passageways 130 and 132 are in the form of upper and lower sleeves 134 and 136, respectively. The sleeves 134 and 136 are constructed of a slippery material, e.g., nylon, to enable the limb units 122 and 124, respectively, to freely slide therethrough to adjust the length that the limbs extend outward from the torso 28.

The doll 120 in FIG. 5 is such that pulling on the left arm 32 increases the distance from the left hand 32H to the torso 28 and correspondingly decreases the distance from the right hand 38H to the torso 28, and vice-versa. Similarly, pulling on the left leg 40 increases the distance from the left foot 40F to the torso 28 and correspondingly decreases the distance from the right foot 34F to the torso 28, and vice-versa.

Lastly, in FIG. 7 there is shown a third embodiment 220 of a doll of this invention. The doll 220 is identical in all respects to the doll 20 except for the construction of its movable limb units and the passageways extending through the torso 28 to receive those limb units. Thus, in the interest of brevity the common features of dolls 20 and 220 will be given the same reference numerals and the details of their construction will not be reiterated. To that end, the doll 220 includes a first movable limb unit 222 and a second movable limb unit 224. The first movable limb unit 222 basically comprises a first unitary elongated member having one end in the form of an arm 32, a second end in the form of a leg 40 and an intermediate or central cylindrical portion 226. In a similar manner the second movable limb unit 224 basically comprises a second unitary elongated member having one end in the form of an arm 38, a second end in the form a leg 34 and an intermediate or central cylindrical portion 228.

The torso 28 of the doll 220 includes a first passageway 230 and a second passageway 232 for slidably receiving the limb units 222 and 224, respectively. The passageways 230 and 232 are formed by the sleeves 234 and 236, respectively, constructed similarly to the sleeves 48 and 50 of the doll 20, but oriented so that each of the passageways 230 and 232 extends generally parallel to the longitudinal axis 10. In particular the sleeve 234 is arcuate, with its central portion 226 extending generally parallel to the longitudinal axis 10. In a similar manner the sleeve 236 is also arcuate, with its central portion 228 extending generally parallel to the longitudinal axis 10.

The doll 220 in FIG. 7 is such that pulling on the left arm 32 increases the distance from the left hand 32H to the torso 28 and correspondingly decreases the distance from the left foot 40F to the torso 28, and vice-versa. Similarly, pulling on the right arm 38 increases the distance from the right hand 38H to the torso 28 and correspondingly decreases the distance from the right foot 34F to the torso 28, and vice-versa.

It should be pointed out at this juncture that heretofore the dolls described have been made of a fabric stuffed with a stuffing so that they are relatively soft, albeit somewhat stiff enough so that the limbs retain their shape. However, it is contemplated that the dolls of this invention could be made out of other materials. For example, the dolls need not be stuffed, instead they can be made out of a plastic, be it hard or soft. In addition, the appearance features of the doll can be less fanciful then that shown, and be more representational of either animals or human beings or any other fanciful character which could be embodied as a doll.

Moreover, it should be pointed out that while the limb units are slidable within the torso of the doll, that embodiment is not the exclusive one. Thus, it is contemplated that the limb units could be arranged to slide within grooves on the surface of the doll, if such an arrangement is desired.

It should also be pointed out that while the ends of the doll are in the form of either hands or feet which are larger in cross-sectional area than the passageway through which the central portion of the limb units extends, that feature is not required. In this regard the enlarged size of the hands and the feet with respect to the central portion of the doll ensures that the limb units will not be dislodged from the doll. This feature may be of considerable importance for dolls for use by young children. However, it is contemplated that the hand and foot could be smaller then that shown so as to fit through the passageway so that the entire limb unit can be removed, thereby enabling the child to disassemble the doll and reassemble it for additional entertainment value.

Without further elaboration, the foregoing will so fully illustrate my invention, that others make by current or future knowledge, readily adapt the same for use under the various conditions of service.

I claim:

1. A doll comprising a head, a torso, a pair of arms, and a pair of legs, said torso having a longitudinal axis and a pair of passageways extending therethrough at respective diagonal orientations with respect to said axis, a first one of said arms and a first one of said legs being formed by a first unitary elongated self-supporting member having a first longitudinal axis, a second one of said arms and a second one of said legs being formed by a second unitary elongated self-supporting member having a second longitudinal axis, each of said first and second members having an intermediate portion, said first one of said arms having an end portion in the form of a first hand asymmetrical with respect to said first longitudinal axis and having a cross sectional area which is greater than that of said intermediate portion of said first member, said first one of said legs having an end portion in the form of a first foot asymmetrical with respect to said first longitudinal axis and having a cross sectional area which is greater than that of said intermediate portion of said first member, said intermediate portion of said first member extending through one of said pair of passageways for sliding and rotary movement therethrough to enable one to readily alter the distance that said first hand and said first foot are located from said torso and to enable one to readily alter the orientation of said first hand and said first foot with respect to said torso, said second one of said arms having an end portion in the form of a second hand asymmetrical with respect to said second longitudinal axis and whose cross sectional area is greater than that of said intermediate portion of said second member, said second one of said legs having an end portion in the form of a second foot asymmetrical with respect to said second longitudinal axis and whose cross sectional area is greater than that of said intermediate portion of said second member, said intermediate portion of said second member extending through the other of said pair of passageways for sliding and rotary movement therethrough to enable one to readily alter the distance that said second hand and said second foot are located from said torso and to enable one to readily alter the orientation of said second hand and said second foot with respect to said torso, whereupon said first and second hand and said first and second foot can be readily placed in a vast multitude of positions with respect to said torso to provide different visual appearances for said doll.

2. The doll of claim 1 wherein said torso is formed of a fabric material shell stuffed with a soft stuffing material, wherein each of said passageways is formed by a respective sleeve of a relatively low-friction fabric, and wherein each of said members comprises a fabric stuffed with a soft stuffing material.

3. The doll of claim 2 further comprising a sounding device.

4. The doll of claim 3 wherein said sounding device is disposed within said doll and is arranged such that the exertion of pressure on said doll actuates said sounding device.

* * * * *